US005395031A

United States Patent [19]

Redmond

[11] Patent Number: 5,395,031

[45] Date of Patent: Mar. 7, 1995

[54] STRESS CONCENTRATOR APERTURE-FORMING MEANS FOR SEALED CONTAINERS AND PACKAGES

[76] Inventor: Sanford Redmond, 746 Riverbank Rd., Stamford, Conn. 06903

[21] Appl. No.: 848,764

[22] Filed: Mar. 10, 1992

[51] Int. Cl.[6] ..... B65D 47/10

[52] U.S. Cl. ..... 222/541; 222/94; 222/107; 206/469; 206/824

[58] Field of Search ..... 222/92, 94, 107, 129, 222/541; 206/469, 634, 484, 824, 634; 401/132, 196

[56] References Cited

U.S. PATENT DOCUMENTS

| | | | |
|---|---|---|---|
| 2,103,389 | 12/1937 | Salifisberg . | |
| 2,499,313 | 2/1950 | Hoag . | |
| 2,864,108 | 12/1958 | Johnson . | |
| 2,956,710 | 10/1960 | O'Connor . | |
| 3,048,878 | 8/1962 | Gray et al. . | |
| 3,184,121 | 5/1965 | Volckening . | |
| 3,189,227 | 6/1965 | Hobbs et al. . | |
| 3,263,863 | 8/1966 | Hoag | 222/541 X |
| 3,315,801 | 4/1967 | Lowry . | |
| 3,334,790 | 8/1967 | Eaton . | |
| 3,369,267 | 2/1968 | Friedland et al. . | |
| 3,386,793 | 6/1968 | Stanton . | |
| 3,418,059 | 12/1968 | Robe . | |
| 3,472,368 | 10/1969 | Hellstrom . | |
| 3,473,650 | 10/1969 | Hoag . | |
| 3,521,805 | 7/1970 | Ward | 222/107 X |
| 3,635,376 | 1/1972 | Hellstrom . | |
| 3,635,567 | 1/1972 | Richardson, Jr. . | |
| 3,741,384 | 6/1973 | Cloud | 222/107 X |
| 3,986,640 | 10/1976 | Redmond | 222/92 |
| 4,236,652 | 12/1980 | Beguhn . | |
| 4,493,574 | 1/1985 | Redmond et al. . | |
| 4,611,715 | 9/1986 | Redmond . | |
| 4,717,046 | 1/1988 | Brogli | 222/541 X |
| 4,724,982 | 2/1988 | Redmond | 222/94 |

FOREIGN PATENT DOCUMENTS

| | | |
|---|---|---|
| 1319723 | 6/1973 | United Kingdom . |

*Primary Examiner*—Gregory L. Huson
*Attorney, Agent, or Firm*—Morgan & Finnegan

[57] ABSTRACT

A stress concentrator aperture-forming structure for containers or packages for flowable products, which allows controlled dispensing of the flowable products with one hand. The stress concentrator includes a substantially flat, relatively stiff sheet, one or more elongated, thin-walled, generally channel-shaped protrusion members, and a fault area crossing one or more of the protrusion members. An enclosed pouch containing the flowable products may also be attached to the stress concentrator. Rupturing the stress concentrator protrusion members across the fault line forms an aperture-forming pattern, which upon application of pressure to the container or package expands to form a larger aperture. Alternate embodiments of the present invention incorporate the rupturable stress concentrator onto containers or dispenser packages for use with a wide variety of products. Another embodiment incorporates the stress concentrator inside a pouch having a slit opening, whereby upon rupturing the stress concentrator the product is dispensed through the stress concentrator and the slit opening.

25 Claims, 8 Drawing Sheets

STRESS CONCENTRATOR APERTURE-FORMING MEANS FOR SEALED CONTAINERS AND PACKAGES

RELATED APPLICATIONS AND PATENTS

The dispenser package structures disclosed in this application represent improvements of or improved additions to the structures disclosed in Redmond U.S. Pat. No. 3,986,640, issued Oct. 19, 1976, Redmond et al. U.S. Pat. No. 4,493,574 issued Jan. 15, 1985, Redmond U.S. Pat. No. 4,611,715 issued Sept. 16, 1986, and Redmond U.S. Pat. No. 4,724,982 issued Feb. 16, 1988, the disclosures of which are hereby incorporated by reference.

BACKGROUND AND OBJECTS OF THE INVENTION

1. Field of the Invention

The present invention relates to dispenser packages for flowable products and the like and, more specifically, to a new and improved configuration and structure of a stress concentrator aperture-forming member for containers and dispenser packages which contain and dispense a quantity of flowable product, having particularly advantageous application to single use containers and packages.

2. Description of the Prior Art

Various attempts have heretofore been made to provide a dispenser package into which a flowable product may be packaged in the quantity normally required for a single use, and from which such flowable material may be dispensed.

One type of package is a pillow pouch or sachet, typically made of relatively thin plastics/and foils or combinations of laminated plastics and foils. These packages are most frequently encountered as containers for catsup, mustard, other condiments, homecare preparations such as hair conditioners, dyes and cremes, et al. Although this type of package is universally used, it is also universally disliked by the consumer. In order to access the contents, the pouch must be held in one hand while a tearing motion and force are applied by the other hand. Creating the initial tear to break the envelope's seal is often very difficult. Moreover, once the initial tear is created, the laminated foil and/or plastic material not only often tears in an uncontrolled fashion, but the holding pressure exerted by one of the user's hands often forces the contents out of the envelope not only before the user is ready to apply the contents but even before the tearing motion is complete. Opening is generally so difficult that the pouch must often be opened by biting. Opening these packages has led to frayed tempers, broken fingernails, and chipped teeth to name a few of the many problems. A further disadvantage is the fact that the user must use both hands to open the container. In the case of invalids, arthritis sufferers and other handicapped people, opening these packages is virtually impossible.

Another package is the peel top cup used for butter, margarine, syrup, sauces, salad dressing, etc. This package also requires good eyesight, manual dexterity, and two hands to open. Similar packages for coffee creamers and the like suffer the same difficulties enumerated above with the pouch or sachet. Indeed, many people cannot open them.

Another type of package is the unsealed paper corrugated package used for salt and/or pepper, which upon bending along a cut through line across the corrugations forms a hole through which the salt or other solid materials contained in the corrugations may flow. These salt packages usually have polyethylene liners which do not rupture or collapse as in the present invention. Also, these packages only dispense dry, solid flowables with the assistance of gravity, and cannot adequately dispense "wet" or liquid flowables nor even contain them as in the present invention, which utilizes hydraulic or compressive forces to direct the stored liquids out of the container.

Redmond's own U.S. Pat. No. 3,986,640 (hereinafter the '640 patent) discloses a dispenser package which represents a marked improvement over the opening difficulties of the foregoing prior package structures in that it accomplishes efficient dispensing of a predetermined quantity of the contents with a one-handed motion and without presenting the opening difficulties previously associated with opening by removal of a cover or tearing of an envelope or pouch. In the '640 patent, the flowable product is contained within a pouch defined by a flexible sheet material and a sheet of relatively stiff material, which has a predetermined fault line or cut pattern scored into the stiff material such that the stiff material will rupture on the fault line when stress is placed upon the sheet of stiff material. Bending the above sheets into a "V" shape ruptures the fault line or cut pattern, which is located in the vertex of the angles formed by the sides of the "V" and creates at least one opening through which the flowable substance is forced upon compression of the flexible pouch by the relatively stiff sides of the "V" as they are brought together. Advantageously, one motion with one hand suffices to open and efficiently dispense the product contained.

The Redmond et al. U.S. Pat. No. 4,493,574 (hereinafter the '574 patent) discloses a dispenser package similar to that of the Redmond '640 patent, but which includes the use of at least one stress concentrator protrusion member displacing at least a portion of the fault line or fault pattern out of the plane of the relatively stiff member. The preferred embodiment of the protrusion member there disclosed has a substantially pyramidal shape which displaces the fault across the apex thereof and is substantially symmetrical with respect to the fault line. The purpose of the stress concentrating protrusion member is to, upon bending into a "V", concentrate stresses at the fault line causing the protrusions to rupture at the locus of the fault line, creating an aperture through which flowable product is dispensed.

The structure of the '640 and '574 patents have been and continue to be commercially successful. However, it was found that in the package configurations therein disclosed, depending upon the particular flowable material enclosed, application of bending pressure could cause a small amount of enclosed material to squirt or "spit" out of the opening at the instant of rupture of the fault line. Redmond U.S. Pat. No. 4,622,715 (hereinafter the '715 patent) substantially reduced this potential squirting problem by providing a shallow channel directly behind the fault line which connects two spaced pockets located on either side of the fault line.

The Redmond U.S. Pat. No. 4,724,982 (hereinafter the '982 patent) also discloses a dispenser package structure similar to the other aforesaid Redmond patents and, in addition, discloses the use of at least one asymmetric substantially pyramidally shaped stress concentrator, which is particularly advantageous where it is desired to simultaneously dispense two different products from isolated chambers.

While the above dispenser packages offer many advantages over prior packaging systems, the above packages nonetheless have certain disadvantages. Although superior to prior pouch style packages and preferred by consumers, the above packages may cost more than the prior pouch packages due to various stiffness and barrier requirements and materials costs. Additionally, because the pyramidally-shaped stress concentrator members protrude outwardly from the surface of the enclosed dispenser package, additional care was needed in packing, stacking, and shipping to prevent inadvertent damage which, although infrequent, caused some dispenser packages to become deformed or even opened prior to use.

3. Objects of the Invention

It is therefore an object of this invention to provide new and improved dispenser packages for flowable products.

Another object of this invention is to provide a new and improved stress concentrator aperture-forming structure for a dispenser package for flowable products which overcomes the drawbacks of the prior stress concentrator aperture-forming protrusion members.

Another object of this invention is to provide a new and improved stress concentrating means for rupturing tough sheet materials or combinations thereof used to form a dispenser package upon bending opposed ends of the package into a "V" shape, and which permits use of a thinner, more flexible and therefore more economical, sheet material for the relatively stiff flat side as well as for the flexible pocket side.

Another object of this invention is to provide a new packaging system that may be constructed from thinner gauge material thicknesses, and therefore requires less material, thereby reducing costs and benefitting the environment.

Another object of this invention is to provide a stress concentrator expandable aperture-forming structure for a dispenser package that permits dispensing of "chunky" style products (salsa with pieces of onion, peppers and tomatoes; salad dressing with chunks of roquefort cheese, etc.).

A further object of this invention is to provide a new and improved stress concentrator aperture-forming structure for a dispenser package which may be combined into a duplex or multiplex package for flowable products which require isolation prior to use.

A further object of this invention is to provide a new and improved stress concentrator aperture-forming structure for a dispenser package which simultaneously dispenses two or more discrete flowable products which are isolated from each other prior to being dispensed.

Another object of this invention is to provide a new and improved stress concentrator aperture-forming structure which opens relatively smoothly and without a snapping action, thereby significantly reducing or eliminating the possibility of squirting or spitting and eliminates the need for the channel construction in the pouch portion of the package disclosed in the '715 patent.

A still further object of this invention is to provide a new and improved duplex or multiplex dispenser package which accurately dispenses equal or unequal quantities of two or more flowable products, where the products may be of the same or different viscosities.

A further object of this invention is to provide a stress concentrator aperture-forming structure for a dispenser package which is resistant to inadvertent opening during shipping or handling as well as damage from packing, particularly when heated where the enclosed product is hot-filled.

A further object of this invention is to provide a new and improved stress concentrator aperture-forming structure which may be sealably mounted onto conventional packages or containers for flowable products, and thereby convert such conventional packages or containers into a one-handed openable package or container.

A still further object of this invention is to provide a new and improved stress concentrator aperture-forming structure which projects inwardly from the plane of the relatively stiff sheet material, such that there are no portions of said stress concentrator which project externally or outwardly from the surface of the package member containing the stress concentrator structure.

The foregoing specific objects and advantages of the invention are illustrative of those which can be achieved by the present invention and are not intended to be exhaustive or limiting of the possible advantages which may be realized. Thus, these and other objects and advantages of the invention will be apparent from the description herein or can be learned from practicing the invention, both as embodied herein or as modified in view of any variations which may be apparent to those of ordinary skill in the art, the same being realized and attained by means of parts, constructions, instrumentations and combinations pointed out in the appended claims. The present invention resides in the novel parts, constructions, arrangements, combinations and improvements herein shown and described.

SUMMARY OF THE INVENTION

Briefly described, the present invention is directed to a new and improved stress concentrator aperture-forming structure which may be mounted onto, or formed integrally with, a container or other dispenser package for flowable products and which may be opened by one hand in a manner to cause controlled rupturing of the packaging material and smooth dispensing of the contents. Materials which are capable of a controlled rupture with the stress concentrator of the present invention range from such low cost, easily rupturable materials as polystyrene to tough, barrier web materials, such as a single sheet comprised of laminates or co-extrusions containing such materials as metal foil, polyester, EVOH, polypropylene, polyethylene, Barex or nylon. The present stress concentrator can reduce costs of the packaging materials as well as provide an improved duplex or multiplex multiple chamber package. Further cost reduction may be realized by reducing the gauge or thickness of the packaging material.

In accordance with a preferred embodiment of the present invention, the dispenser package comprises a relatively stiff flat sheet having a tough, high barrier layer secured to at least one surface thereof, a flexible sheet secured to said one surface of the relatively stiff sheet to form an enclosed pouch adjacent the relatively stiff side, a cut pattern or fault line or other fault area scored or otherwise formed in the relatively stiff sheet generally along the transverse center line thereof, and at least one, but preferably two or more, adjacent and parallel stress concentrator aperture-forming protrusion members inwardly displacing at least a portion of the fault line or fault pattern of the relatively stiff sheet, each of said protrusion members preferably comprising an elongated, thin-walled generally channel-shaped configuration, which configuration is expandable upon rupture.

Advantageously, the aforesaid preferred elongated channel-shaped configuration is positioned generally perpendicular to the fault line, and several of the stress concentrators may be employed, preferably in parallel and adjacent to one another, forming a stress concentrator aperture-forming pattern which facilitates rupturing of the container and which is also expandable upon rupture to further facilitate release of the materials stored therein. In a preferred embodiment the channel configuration in cross-section has a rounded bottom and a pointed or rounded crest or peak. In a further preferred embodiment, the fault line traverses only some of the channel-shaped stress concentrator members. Thus, for example, interior stress concentrating channels that act as rupturing members are traversed or scored by the fault line, and outer stress concentrating channels which may be scored or not by the fault line act as stiffeners or guard channels, which serve to resist inadvertent opening of the rupturing members during transportation and storage of the dispenser package. The outer channels additionally have a significant effect on the forces which control the manner in which the package opens. Also, as preferably embodied, the stress concentrator pattern of elongated channels are recessed below the plane of the relatively stiff sheet surface, further strengthening the thin outer surface of the relatively stiff sheet and further resisting inadvertent opening when the dispenser package is pressed or bent the "wrong" way i.e., opposite the normal opening direction.

In accordance with another preferred embodiment of the present invention, a duplex or multiplex dispenser package is provided which comprises at least two closely adjacent, separately enclosed chambers, each chamber having one side facing the relatively stiff flat sheet, and at least one stress concentrator aperture-forming protrusion member positioned above an enclosed chamber and may displace at least a portion of the fault line or fault pattern out of the plane of the relatively stiff flat sheet in a direction away from its associated enclosed chamber. Each stress concentrator aperture-forming member is preferably perpendicular to the fault line, and extends along the length of the relatively stiff flat sheet.

It will be seen from the foregoing that the multiple chamber arrangement of the latter embodiment provides a dispenser package which may contain at least two discrete flowable substances which are isolated from each other prior to use but which are opened and dispensed essentially simultaneously from the two separate openings formed by rupture of the channel-shaped stress concentrator members upon bending of the package into a "V" shape. Advantageously, and preferably, a plurality of the aforesaid stress concentrator aperture-forming members are positioned and aligned in a parallel and closely facing relationship. It has been found that such a duplex or multiple chamber package can be constructed so that, upon rupture of said channel-shaped stress concentrator members, the separately contained flowable substances are dispensed in two closely spaced streams that are easily directed into contact with each other.

As used herein, the terms "fault line" or "fault pattern" are intended to encompass the aforesaid alternatives of a cut pattern, a single straight line extending across a portion of all of the relatively stiff flat sheet, or a fault area formed by weakening means other than by a scored continuous line.

It will be apparent from the foregoing general description that the objects of the invention specifically enumerated herein are accomplished by the invention as here embodied.

Thus, in accordance with the preferred embodiments of the invention, it has been found that a dispenser package constructed of high strength, high quality barrier material may be opened by rupture of a plurality of parallel elongated and thin-walled stress concentrating channel-shaped members, that the aperture formed upon rupture of such a pattern of channel-shaped members is expandable, and that such an aperture-forming structure can be constructed more economically, utilizing thinner gauge materials than those utilized to construct prior dispenser packages having externally projecting stress concentrating protrusion members, such as shown in one or more of the aforesaid Redmond patents.

In another preferred embodiment of the present invention, the aforesaid stress concentrator aperture-forming means is used to provide a similar means of access to flowable products stored in any all-purpose package container. Thus, as here embodied, the aforesaid stress concentrator aperture-forming structure is formed in a sheet of relatively stiff, thin-walled material which is then suitably sealably mounted over an opening provided in the wall of a conventional container, such as for milk, juice, oil, etc. The stress concentrating aperture-forming structure of the present invention may be ruptured not only by bending pressure, but by internal pressure as well. Thus, for example, squeezing a milk container causes the aforesaid stress concentrator to rupture the fault line, providing access to the milk stored therein, creating an opening which remains open by continued squeezing. Upon release of pressure the stress concentrator reverts to its original closed position, albeit no longer in a sealed condition.

Another preferred embodiment of the present invention employs the stress concentrating means as disclosed in the dispenser package embodiment but positioned inside a dispenser package or container instead of exterior to it as in the previous embodiments. In this embodiment, a small slit or opening is made in the wall of the package or container. The stress concentrator is then positioned on the inside of the wall over the slit or opening and sealed around it, thereby preventing the flowable substance from contacting the slit or opening. The flowable substances may then flow out of the container or package through the ruptured stress concentrator and slit or opening by squeezing or bending the dispenser package.

It will be appreciated by those skilled in the art that the foregoing brief description and the following detailed description are exemplary and explanatory of the present invention, but are not intended to be restrictive thereof or limiting of the advantages which can be achieved by the invention or various combinations thereof. The accompanying drawings, referred to herein and constituting a part hereof, illustrate preferred embodiments of the invention and, together with the detailed description, serve to explain the principles of the invention.

BRIEF DESCRIPTION OF THE DRAWINGS

FIG. 1B illustrating the fault line extending across the entire stress concentrating pattern, FIG. 1C illustrating the fault line extending across the face of the relatively stiff side of the stress concentrator member beyond the stress concentrating pattern, and FIG. 1D illustrating both the inner rupturing and outer guard stress concentrating members having identical lengths;

FIG. 8A shows a container such as for milk or orange juice; FIG. 8B shows a cylindrically shaped container; and FIGS. 8C–8G show another form of dispenser package;

DESCRIPTION OF THE PREFERRED EMBODIMENTS

Figure 1A:
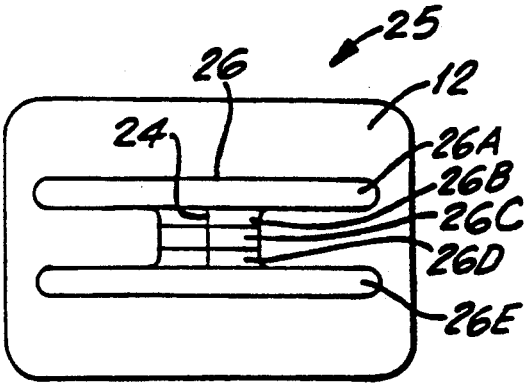
FIG. 1A is a top plan view of a preferred stress concentrator member constructed in accordance with the present invention, the view showing a recessed stress concentrating pattern including several stress concentrating protrusion members on the relatively stiff top side of the stress concentrator member, the protrusion members oriented perpendicularly to a fault line, showing the outer guard stress concentrating members having a greater length than the inner rupturing members, and the fault line traversing only the inner rupturing stress concentrating members.
Figure 1B:
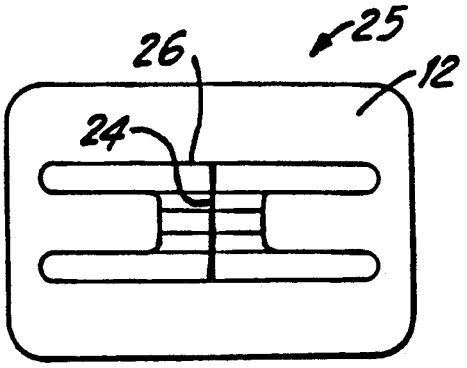
FIGS. 1B–1D are top plan views illustrating various other stress concentrating patterns in accordance with the present invention.
Figure 1C:
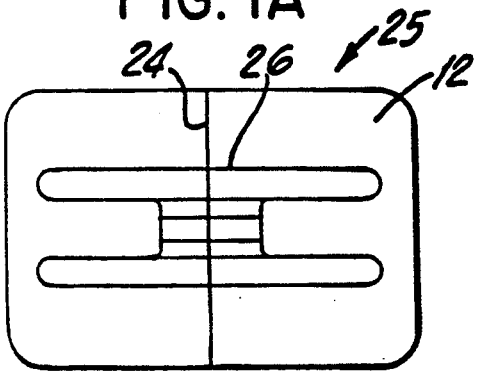
Figure 1D:
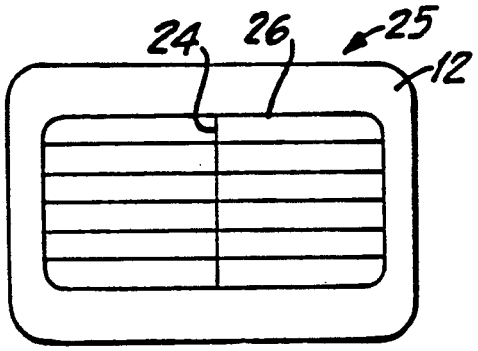
Figure 2:
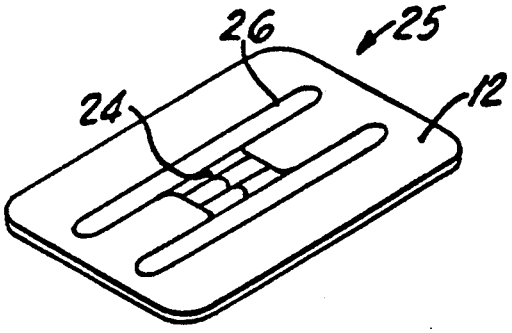
FIG. 2 is a view in perspective of the stress concentrator member shown in FIG. 1A.

Referring now more particularly to FIGS. 1 and 2 of the accompanying drawings, there is illustrated a stress concentrating member for containers and dispenser packages constructed in accordance with the present invention, indicated generally by 25.

As here embodied and illustrated in FIGS. 1 and 2, stress concentrating member 25 of the present invention includes a substantially flat and relatively stiff sheet 12 having a stress concentrating pattern 26 on one surface of sheet 12. Sheet 12 is preferably made of a plastic material most suitable to the product contained and the protection it requires.

Figure 3:
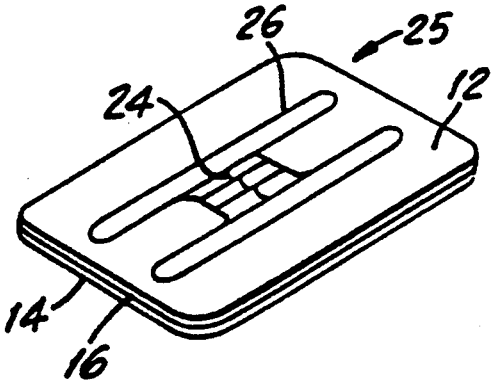
FIG. 3 is a view in perspective another stress concentrator member having a barrier layer.

Materials, such as high-impact polystyrene (HIPS), high density polyethylene (HDPE) polyester, Barex, polypropylene, etc., may also be used. For surface materials having high moisture vapor transmission rates, a sealant/barrier 14 may be suitably bonded to the inner surface 16 of substantially flat relatively stiff sheet 12 so that sheet 12 and sealant/barrier 14 are rendered integral with one another, as shown in FIG. 3. As understood by those skilled in the art, whereas plastics of similar material may be heat-sealed or bonded together, bonding different plastics together requires adhesives. Preferably, linear low density polyethylene (LLDPE) is used as an adhesive. Thus, multi-layered plastics formed by coextrusion may be sealed together to form the sheet 12 and sealant/barrier 14 of the present invention.

Stress concentrating member 25 may be secured to any container for flowable substances, and is provided with a stress concentrating protrusion pattern 26, having one or more stress concentrating protrusion members 26A, 26B, 26C, 26D, 26E or more preferably formed perpendicularly to a fault line 24. Shown in FIG. 1A is a preferred stress concentrating member 25, having a preferred pattern 26 with members 26A–26E. As here preferably embodied, protrusion members 26A–26E are formed in the shape of a trough, flute, or channel configuration. Protrusion members 26A and 26E are preferably longer than members 26B–26D, which act as guard or stiffening protrusion members and are preferably on either side of said shorter rupturing protrusion members. The length of guard members 26A and 26E in relation to the inner protrusion members 26B–26D is dependent upon the number of inner members, their size, spacing and shape. Thus, the ratio of length between the non-rupturing guard protrusion members and the rupturing protrusion members changes, but a generally preferred range is 5 to 20, and a more preferred range is 5 to 10. Guard protrusion members may also be placed in between the shorter rupturing protrusion members to provide added support or other properties to stress concentrating member 25.

As shown in FIG. 1A, fault line 24 is preferably form, by scoring said stress concentrating member 25 across said stress concentrating protrusion pattern 26. Preferably, fault line 24 traverses only the inner rupturing protrusion members 26B–26D. It will be understood that the fault line 24 of the present invention is not limited to a linear fault pattern, but may encompass various fault patterns or weakened areas. Also, fault line 24 may traverse some but not all rupturing members, forming an interrupted fault line. Further, fault line 24 may traverse the protrusions in the stress concentrating protrusion pattern 26 at other orientations than that shown in FIGS. 1A–1D, depending upon factors such as type of material used and flowable substance contained. As noted, the longer guard protrusion members 26A an 26E are preferably not traversed by fault line 24, and may thereby resist inadvertent opening of the inner rupturing protrusion members 26B–26D during transportation and storage. Further, the unscored guard protrusion members have a significant effect upon the forces which control the manner in which the container opens.

FIGS. 1B, 1C and 1D show alternate configurations of the stress concentrating pattern 26. In FIG. 1B, fault line 24 on relatively stiff flat sheet 12 traverses the entire stress concentrating pattern 26, including not only the shorter rupturing protrusion members 26B, 26C and 26D, but also the longer protrusion members 26A and 26E, which now also act as rupturing members. FIG. 1C shows fault line 24 extending beyond stress concentrating pattern 26 to the side edges of relatively stiff flat sheet 12. FIG. 1D illustrates a stress concentrating pattern 26 having the inner and outer protrusion members of the same length. Additional configurations or orientations of the protrusion members of stress concentrating pattern 26 of stress concentrating member 25 are readily apparent to those skilled in the art. Also, protrusion members 26A–26E preferably form elongated, thin-walled, rib-like and channel-shaped configurations.

Figure 4A:
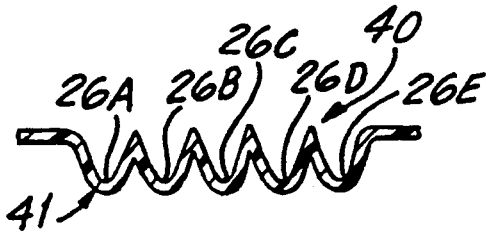
FIG. 4A is a view in cross-section of a stress concentrator member constructed in accordance with a preferred embodiment of the present invention about the fault line, illustrating a series of channels having pointed peaks and rounded valleys.
Figure 4B:
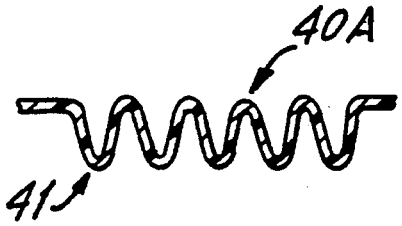
FIG. 4B is a view in perspective of the stress concentrator member shown in cross-section in FIG. 4A, illustrating a series of channels having rounded peaks and rounded valleys.
Figure 4C:
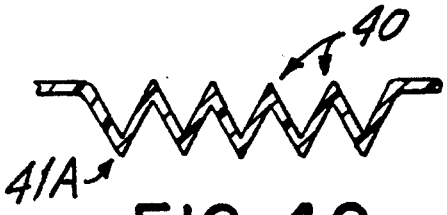
FIG. 4C is a view in perspective of the stress concentrator member shown in cross-section in FIG. 4A, illustrating a series of channels having pointed peaks and pointed valleys.

In FIG. 4A stress concentrating member 25 is shown in cross-section about fault line 24. As preferably embodied, stress concentrating protrusion members 26A–26E have rounded bottoms 41 to better prevent inadvertent rupture and sharp crests or peaks 40. Alternative embodiments, however, may include rounded bottoms 41 and peaks 40A, as shown in FIG. 4B, sharp bottoms 41A and peaks 40, as shown in FIG. 4C, sharp bottoms and rounded peaks (not shown), and combinations thereof.

Figure 4D:
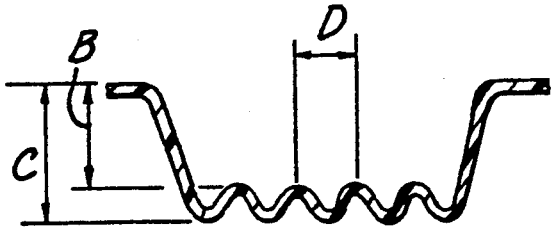
FIG. 4D is a view in perspective of the stress concentrator member constructed in accordance with the present invention, illustrating a recessed stress concentrating pattern, having a series of rounded peaks and valleys.
Figure 4E:
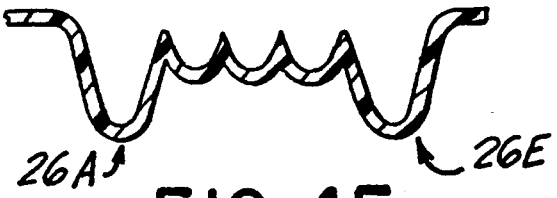
FIG. 4E is a view similar to FIG. 4D, having more deeply recessed guard members and pointed peaks and rounded valleys.

Stress concentrating pattern 26 may also be recessed from the plane formed by the Substantially flat relatively stiff sheet 12, as shown in FIG. 4D: a preferred embodiment of the dispenser package embodiment discussed below. Recessing stress concentrating pattern 26 not only increases the stiffness of stress concentrating member 25 but also resists inadvertent opening of a container utilizing said member 25 during packing, storage, or transportation due to undesirable downward pressure upon stress concentrating pattern 26. As shown in FIG. 4D, stress concentrating pattern 26 is recessed an amount B, preferably approximately 0.030" and protrusion members 26A–26E are spaced an amount D, preferably approximately 0.080" and are an amount C, preferably approximately 0.080", deep (from the plane formed by the substantially flat relatively stiff sheet 12). The thickness of the substantially flat relatively stiff sheet 12 is preferably 0.006" along the outer plane as well as within the stress concentrating pattern 26, but may range in the thickness over the range 0.004–0.012". Preferably, the recessed protrusion member: 26A–26E have rounded bottoms 41 and sharp peaks 40. As shown in FIG. 4E, guard protrusion members 26A and 26E may be recessed deeper than stress concentrating pattern 26 to provide more support and greater resistance to inadvertent or even intended opening, e.g. a container containing a potentially dangerous flowable substance will only open upon exertion of sufficient pressure and not less. Also, guard protrusion members may be placed in between the rupturing members to provide additional support.

It should also be readily understood by those skilled in the art that the size and shape, i,e., pointed or rounded, of said protrusion members in the stress concentrating pattern 26 may be varied within the pattern, thereby combining the features of the patterns heretofore described.

Referring now more particularly to FIG. 5 of the accompanying drawings, there is illustrated a dispenser package employing a stress concentrator member 25 in accordance with the present invention, and indicated generally by reference numeral 10.

Figure 5A:
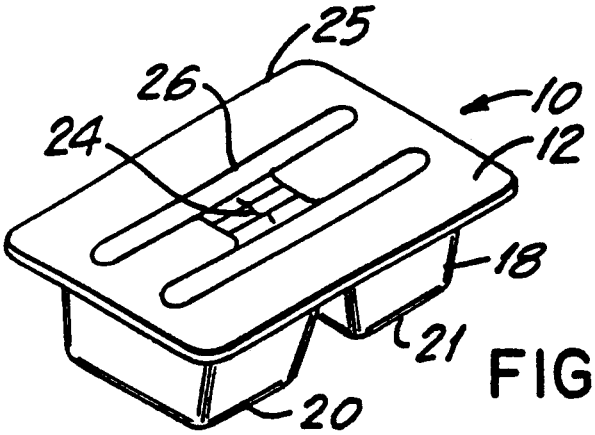
FIG. 5A is a view in perspective of a dispenser package constructed in accordance with the present invention, the view showing the package in its pre-opened condition.
Figure 5B:
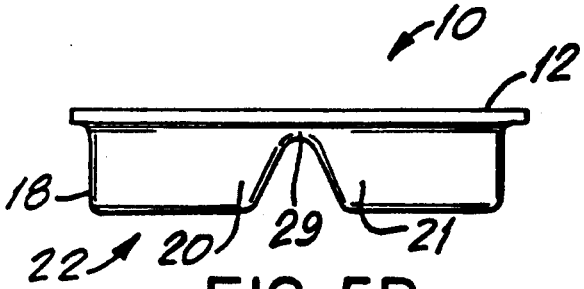
FIGS. 5B and 5C are front and side plan views of the dispenser package shown in FIG. 5A.
Figure 5C:
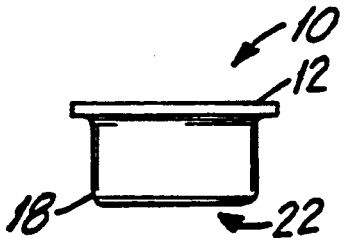

As here embodied and illustrated in FIGS. 5A–5C, dispenser package 10 includes a substantially flat relatively stiff sheet 12 as described above, which may also have a sealant/barrier 14 suitably bonded to the inner surface 16 of sheet 12 so that sheet 12 and the sealant/barrier 14 are rendered integral with one another. Also suitably integrally bonded to the outer perimeter of sheet 12 or bonded sheet 12, 14 is a flexible self-supporting sheet 18 forming at least one pouch or chamber 22 adjacent the aforesaid inner surface 26 of flat sheet 12 for containing a flowable substance.

Advantageously, and as here preferably embodied, the layer of a suitable sealant/vapor impervious barrier material 14 is suitably integrally bonded to flat sheet 12 on the inner surface 16 which faces flexible sheet 18. Flexible sheet advantageously formed by conventional means, such as vacuum forming, pressure forming, mechanical forming or combinations thereof, is likewise suitably integrally bonded to sheet 12, 14 as the case may be.

The bonds between substantially flat relatively stiff sheet 12, sealant/barrier material 14 and flexible side 18 also may be formed by conventional means known to persons of ordinary skill in the packaging art, such as welding, heat sealing, or adhesive or cohesive bonding, the particular bonding method selected depending upon the particular properties of the materials used and the flowable substance(s) to be contained.

Advantageously, and as preferably embodied, substantially flat relatively stiff sheet 12 is preferably made of high-density polyethylene (HDPE), but when combined with barrier 14 may be made of polystyrene, polyester, EVOH (ethylene vinyl alcohol), or a copolymer thereof, and barrier 14 is made of a suitable sealant/vapor impervious barrier material comprising saran and foil laminate, or comprising a laminate of foil and vinyl, or foil alone, depending upon the nature of the contents to be contained. A particularly tough, high barrier construction comprises saran laminated on each side with polyethylene (sold by Dow Chemical Co. under the name "Saranex") as the barrier sheet 14, in turn laminated onto polystyrene or polyester, forming the substantially flat relatively stiff sheet 12. The thickness of substantially flat relatively stiff sheet 12 varies according to factors, such as the properties of the materials used, flowable substance contained, and intended usage. A generally preferred range is 4–12 mils (0.004–0.012"), and a more preferred range is 4–6 mils. Also, substantially flat relatively stiff sheet 12 is preferably also relatively flexible, spring-like, and capable of being stiffened by ribbing material.

It will be understood of those of ordinary skill in the art that the bonds formed between materials 12, 14 and 18 can be obtained by the conventional means previously described, again depending upon the nature of the flowable substance being contained. These and other equivalent materials and bonding systems are described in the aforementioned '640, '574 '715 and '982 patents, the disclosures of which are hereby incorporated by reference.

It will be seen from the foregoing that the structure of FIGS. 5A–5C forms an enclosed pouch or chamber 22 between flexible side 18 and substantially flat relatively stiff sheet 12, 14 in which the flowable substance is contained and from which the flowable substance is dispensed. Advantageously, the enclosed pouch or chamber 22 comprises a pair of laterally spaced pockets 20, 21, as shown in FIGS. 5A and 5B, which may be interconnected by a shallow duct or channel 29, more fully described in the aforesaid Redmond '715 patent.

Prior packaging systems, such as disclosed in the '640, '574, '715 and '982 patents, involve symmetric or asymmetric stress concentrating members which extend above the plane formed by the substantially flat relatively stiff sheet 12 and barrier 14. As previously discussed, the higher the protrusion, the more likely the package will be damaged during transportation and handling. One of the governing factors in determining the requisite height of the stress concentrating protrusion member is the elasticity of the substantially flat relatively stiff sheet 12, which may incorporate a sealant barrier layer 14. Decreasing the height of the protrusion results in a smaller dispenser opening 30, per protrusion channel and less rupturing damage, as shown in FIG. 7. Thus, the minimum height of an external protrusion is limited by the type of plastic, its thickness and physical qualities.

As described in the '574 patent, more dispenser openings and greater flow can be generated by increasing the number of external protrusion members. Further, lengthening the stress concentrating protrusions to extend substantially the full length of the package also greatly increases its stiffness, thereby reducing the gauge requirement of the top side and permitting lower costs. As a result of this stiffening and shallow depth, the external protrusions on the package may be straight "V" shaped flutes, ridges or channels along or adjacent to one another. Nonetheless, the external protrusion members of these previous systems cause several problems and disadvantages, particularly due to inappropriate rupturing.

In accordance with the present invention, dispenser package 10 is preferably provided with a recessed stress concentrating pattern 26 as described above, with one or more troughs or flutes extending inward from the outer surface of the relatively stiff flat sheet 12, instead of outward as in the previous patents. This inversion of the stress concentrating protruding member overcomes many of the difficulties and disadvantages present in the prior patents. First, the outer surface of the substantially flat relatively stiff sheet 12 remains planar without any protruding peaks extending out of the plane away from the enclosed pouch 22. This allows far more efficient packaging and decreased dangers of inadvertent rupture during transportation or storage. Second, printing on the substantially flat relatively stiff sheet 12 over the stress concentrating pattern 26 remains readable, unlike printing on the prior externally protruding members. Third, package stiffness is greatly increased over prior external protrusion packages due to "crush points" that resist inadvertent opening. Lastly, the present configuration allows for the use of thinner and/or softer, and therefore lower cost materials not only for the substantially flat relatively stiff sheet 12 but also for the barrier 14, which previously lent an important degree of rigidity to the package. The reduced cost and usage of elastic material makes the package of the present invention both economically and environmentally preferable to all present dispenser packaging.

It will be seen from the foregoing, and as described in more detail in the aforesaid Redmond patents that fault line 24 acts as a guide for controlled rupture of substantially flat relatively stiff sheet 12 as package 10 is bent into a "V" shape about fault 24. As substantially flat relatively stiff sheet 12 is bent into a "V" shaped configuration, stress is concentrated or focused in a manner different from the outwardly protruding stress concentrating configurations in prior patents, such as the Redmond '574.

Figure 6A:
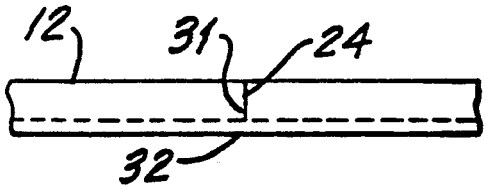
FIG. 6A shows a side view of the substantially flat relatively stiff sheet in its pre-opened condition.
Figure 6B:
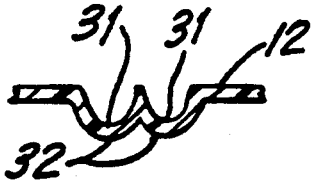
FIG. 6B shows a view in cross-section of the substantially flat relatively stiff sheet shown in FIG. 6A having only one flute.
Figure 6C:
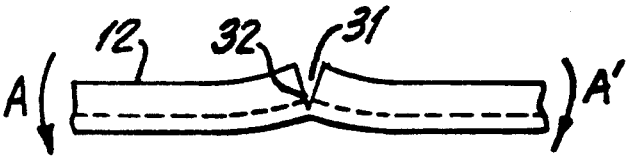
FIG. 6C shows a similar view of the dispenser package of FIG. 6A in use, this view illustrating the package upon initial bending and at its moment of rupture along the fault line.
Figure 7A:
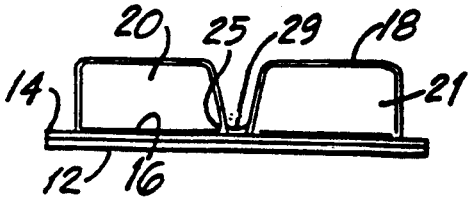
FIG. 7A is a view in side elevation of a dispenser package constructed in accordance with a preferred embodiment of the present invention in its pre-opened condition.
Figure 7B:
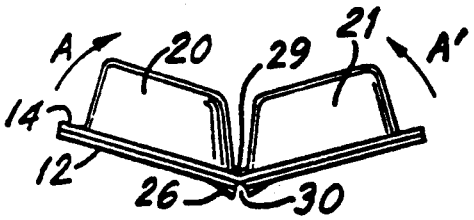
FIG. 7B is a similar view of the dispenser package of FIG. 7A in use, this view illustrating the package upon initial bending and at its moment of rupture at the fault line.
Figure 7D:
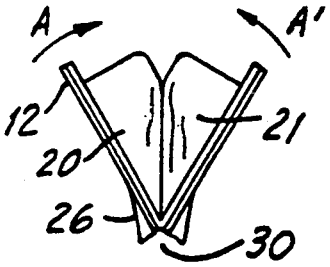
FIG. 7D is a similar view of the dispenser package of FIG. 7B in use, this view illustrating the package upon further bending and rupturing along the fault line.
Figure 7C:
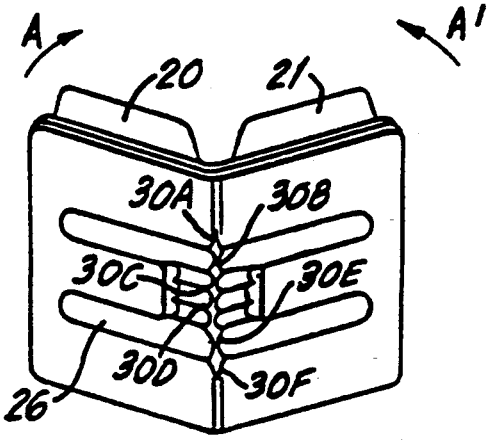
FIG. 7C is a view in perspective of the dispenser package of FIG. 7B in use, and also at the moment of rupture at the fault line.

Unlike the prior Redmond patents, a pivot point 31 of the present embodiment does not lie on or within the surface of substantially flat relatively stiff sheet 12 but instead drops beneath the stiff flat side 12 toward the bottom 41 of the stress concentrating protrusion members, as shown by reference numeral 31 in FIGS. 6A and 6B. The pivot point 31 therefore becomes a fulcrum between the peak 32 of preferably rounded bottom 41, which becomes a "crush" point, and the plane of the substantially flat relatively stiff sheet 12. Upon application of force designated by A and A', as also shown in FIGS. 7B–7E, pivot point 31 moves until reaching the plane formed by the outer surface of the substantially flat relatively stiff sheet 12. The crushing forces caused by the A, A' movement of the dispenser package 10 also causes the crush point 32 to migrate in the same direction as the pivot point 31. The result of this combination of crush points and relocated pivot points is that, when the package is bent into a "V", the crushing forces at the crush points force the crush points to the plane of the substantially flat relatively stiff sheet 12. This causes an arcuate configuration on each side of the rupturing stress concentrating members, as shown in FIG. 7C.

Figure 7E:
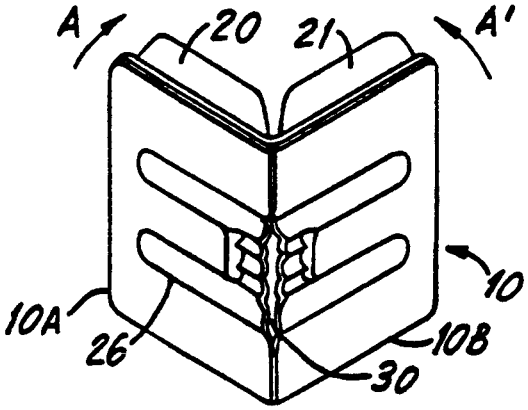
FIG. 7E is a similar view of the dispenser package of FIG. 7C, this view illustrating the package upon further bending and rupturing and showing the creation of the dispenser opening.

Although the stress concentrating means of the present invention works with single or dual flute configurations, the present invention shows further unique characteristics when the number of flutes is increased to 3, 4 and 5 or more. With the larger number of flutes in the stress concentrating pattern 26, combined with the use of unscored, guard protrusion members 26A and 26E as shown in FIG. 1A, when dispenser package 10 is bent into a "V" configuration, the pattern 26 bulges outwardly, as shown in FIGS. 7B and 7D, creating an expandable dispensing aperture 30, as shown in FIG. 7E, which is roughly shaped like an oval, a football or an ellipse. Aperture 30 is a relatively large opening compared to the opening created by the previous Redmond stress concentrators.

Another advantage over the prior Redmond patents is that the stress concentrating means of the present invention tends not to squirt upon initial rupturing. Indeed, it was found that the stress concentrating means of the present invention tear open, but do not snap, and are thus inherently non-squirting. The anti-squirt feature disclosed in the Redmond '715 patent is thus unnecessary. Since the anti-squirt feature by its very nature tends to block the flow path, elimination of this feature at least beneath the stress concentrating means allows dispenser package 10 to dispense "chunky" products, such as blue cheese, salad dressing, mustard/relish combination, chunky peanut butter, salsa, and any other chunky yet flowable products.

Figure 7F:
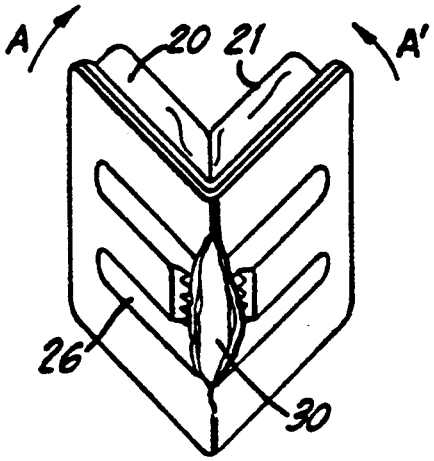
FIG. 7F is a similar view of the dispenser package of FIG. 7E, this view illustrating the package upon even further bending, showing the creation of a larger dispenser aperture which would allow passage of chunky products.

In researching better constructions and designs for the package and stress concentrator in order to reduce costs, it was found that extending the length of the stress concentrator 26 to substantially the length of the package stiffened thin films. While a single long protrusion was effective in stiffening the protrusion side, the rate of dispensing the product was greatly limited. Larger protrusions, although increasing dispensing rate, required thicker and thus more expensive films. Increasing the number of protrusions or members in the stress concentrator as shown in FIG. 7, especially where the members are adjacent, increased dispensing rate. For example, for six $\frac{1}{8}''$ wide adjacent protrusions crossing the fault line 24, aperture 30 width is $\frac{3}{4}''$. Further investigation revealed that the preferred "accordion"-shaped corrugations along aperture 30 "stretch" or de-accordion to form an even larger opening, as shown in FIG. 7F, allowing very large chunks up to $\frac{1}{2}''$ in diameter to pass through. The accordion pleats simply flattened out to create the expanded aperture 30 in FIG. 7F.

It will be apparent from the foregoing and as shown in FIGS. 7E and 7F, that the localized opening created at expandable aperture 30 develops a highly directed stream of the flowable substance as the rigid side halves 10A, 10B, as shown in FIG. 7E, act cooperatively with flexible side 18 to squeeze and expel the contents of pouches 20 and 21.

Additional embodiments of the present invention form flexible sheet 18 into two or more separately enclosed, closely adjacent pouches or chambers to thereby form a "duplex" dispenser package. Such duplex dispenser packages may contain two or more separate and distinct products isolated from each other prior to use and combined simultaneously upon opening. Preferably, dispenser containers having multiple chambers have a separate fault line across each chamber. Additional embodiments of the present invention provide compartments of different sizes, where unequal quantities of different products may be separately stored and yet may be dispensed both accurately and essentially simultaneously.

It will be understood that the construction of relatively stiff flat sheet 12 in either of the previously described embodiments may be advantageous even when no extra sealant or barrier material 14 is required, and such construction is within the scope of the present invention. As previously described in connection with the use of a localized fault line, such a construction may be particularly desirable in dispensing low viscosity flowable substances such as water, cream or alcohol in a highly directed stream from an essentially dripless package. Such flowable substances do not require a special sealant/barrier layer 14 and yet are appropriate substances for a dispenser having the other advantages of the present invention.

The stress concentrator pattern 26 hereto has been shown in association with dispenser packages 10 for small quantities of flowable substances, which are opened by bending the package and rupturing along a fault line 24. Stress concentrator pattern 26, however, may also operate by means of internal pressure, for example, squeezing the container or package. In this alternate embodiment of the invention, stress concentrator pattern 26 may be used in association with any all-purpose containers for flowable substances, such as orange juice and milk containers, tooth paste, motor oil, or other flowable substances. Preferably, stress concentrator pattern 26 opens upon squeezing the container and also automatically retracts upon release, thereby covering the enclosed flowable substance, albeit not necessarily resealing it.

In this alternative embodiment, stress concentrator member 25 is preferably formed as in the previous embodiment: a substantially flat relatively stiff sheet 12, a stress concentrating pattern 26, including a series of opposed, closely spaced, substantially flute-shaped stress concentrating protrusion members 26A–26E, and a fault line 24, all as previously described. Stress concentrator member 25 is preferably affixed within or on the top or side of a container, as shown in FIGS. 8A–8B, by heat-sealing, adhesives, or any other affixation method known to those skilled in the art.

Figure 8A:
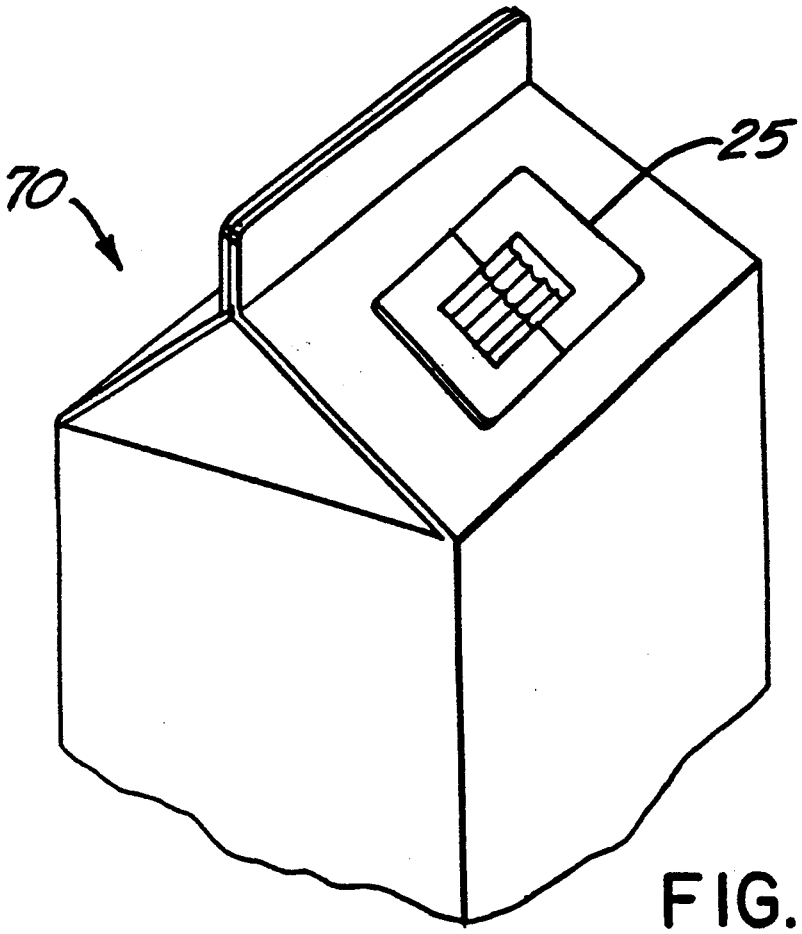
FIGS. 8A–8G are views of the stress concentrator member of the present invention used in various containers.

Shown in FIG. 8A is stress concentrator member 25 on the side of a container 70, such as for milk or orange juice. Stress concentrator member 25 and stress concentrating pattern 26 are preferably operated by squeezing the container 70, thereby generating internal pressure upon the stress concentrating pattern 26, causing it to rupture substantially as before in the previous embodiment along fault line 24. The contents may then be dispensed. Alternatively, stress concentrating pattern 26 may be manipulated by the user to rupture along fault line 24, without necessarily creating internal pressure, by bending stress concentrating pattern 26 to rupture, as described in the dispenser package embodiment.

Figure 8B:
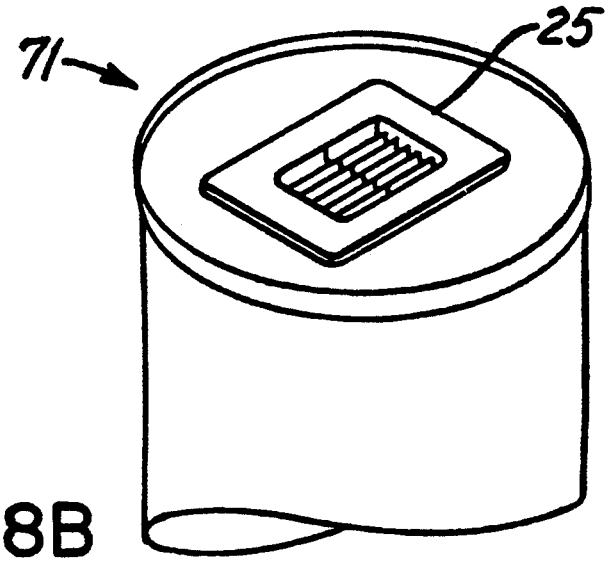
Figure 9A:
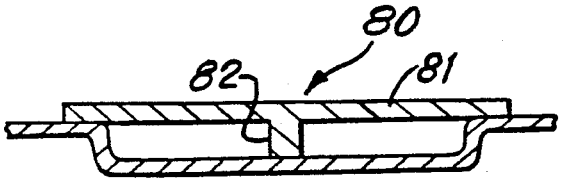
FIGS. 9A and 9B are cross-sectional and outline views of a cover and strut member for preventing the stress concentrating pattern from prematurely rupturing.
Figure 9B:
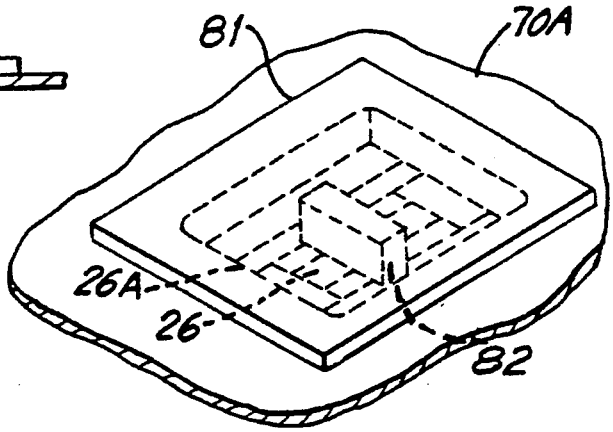

Shown in FIG. 8B is a cylindrical container 71 having stress concentrator member 25 with stress concentrating pattern 26 on the top thereof. Squeezing the sides of container 71 ruptures the stress concentrating pattern 26, which until the application of pressure was preferably sealed, thereby allowing the user to access the enclosed substance. Preferably, stress concentrator member 25 is covered to prevent inadvertent premature rupturing of stress concentrating pattern 26. Preferably a strut 80 covers stress concentrating pattern 26 during shipping and storage. Strut 80 reinforces the stress concentrating pattern 26 and helps prevent accidental opening due to accidental pressures upon the container prior to use. Preferably, strut 80 should be readily removable, as with a peel-off strut. FIG. 9A shows an embodiment of strut 80, which includes a peel-off cover 81, which is affixed onto the surface 70A of container 70 and preferably over stress concentrator member 25; and a strut member 82, which is affixed to the cover 81 and extends perpendicularly-to contact the stress concentrating pattern 26 within stress concentrator member 25, as shown in FIG. 9B.

Preferably, strut member 82 applies pressure to the stress concentrating pattern 26 in the opposite direction of the pressure needed to open the pattern 26, i.e., strut 82 applies a countervailing force against pattern 26 to prevent internal pressures from within the container from rupturing the protrusion members of the pattern 26. Peeling off the cover 81 along with the strut member 82, releases the countervailing force preventing stress concentrating pattern 26 from rupturing and opening. Removal of the cover 81 allows the user to squeeze the container and access the contents stored within. FIG. 9B shows peel-off cover 81 on the container surface 70A. Strut member 82, stress concentrator member 25, and stress concentrating pattern 26 are also shown.

Additional protective covers over stress concentrating pattern 26 may include a cover 81 without strut 82, or any other protective covers readily understood by those skilled in the art.

As with container 70, a strut 80 may be used to ensure sealing of the container, such as for milk products. Strut 80 may be removed to allow the user to access the contents. Since the stress concentrator member 25 does not reseal, a sealing cover such as an adhesive may be employed to fit over said stress concentrator member 25 to provide a sanitary seal for products, such as milk, which spoil.

Figure 8G:
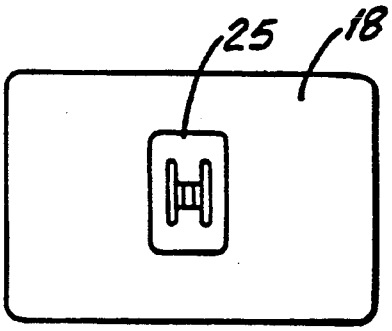
Figure 8F:
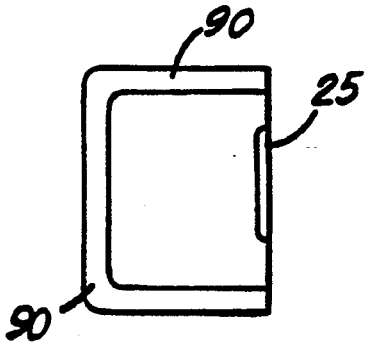
Figure 8E:
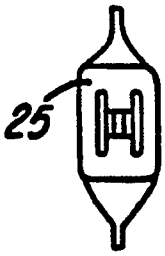
Figure 8C:
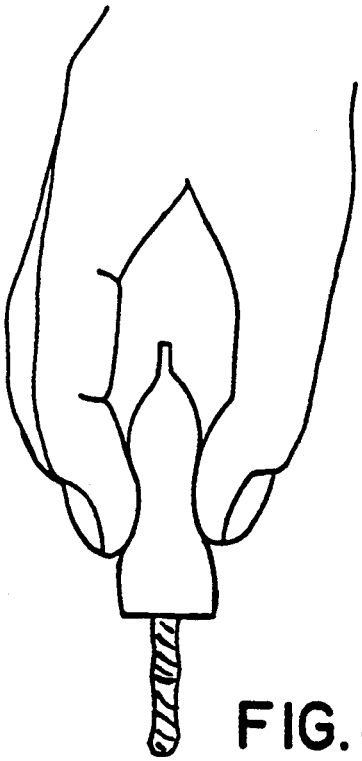
Figure 8D:
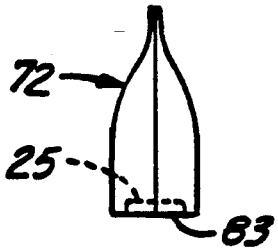

Another use for stress concentrating member 25 is shown in FIGS. 8C–8G. The dispenser package shown in FIGS. 8C–8G has a stress concentrating member 25 along a dispensing surface 83 of dispenser 72, which is formed by folding and sealing a flexible sheet of material 18, as shown in FIG. 8G to the shape shown in FIGS. 8C–8F, and sealing the edges along edge 90, as shown in FIG. 8F. Squeezing dispenser 72, as shown in FIG. 8C, ruptures the stress concentrating pattern 26 and releases the product stored within. Further squeezing removes the remaining contents from the dispenser 72.

Figure 10A:
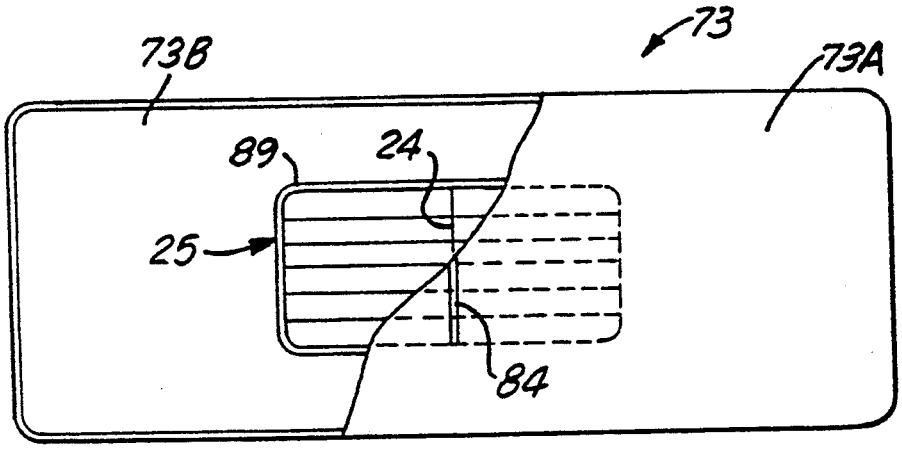
FIG. 10A is a sectional view of a pouch container, such as for catsup, including the stress concentrator member of the present invention, also showing the slit opening which is atop the fault line of the stress concentrating pattern.

Another embodiment of the present invention is a new and improved pillow container or sachet, such as for catsup, mustard, etc. As shown in FIG. 10A, stress concentrator member 25 may be affixed within the sachet container 73. The sachet 73 in this embodiment preferably includes a pouch made of laminate of saran coated polyester of thickness 0.001" (50 calibers), 0.000285" aluminum foil, and an inner layer of 0.0025" LLDPE. A portion of inner layer LLDPE is shown in cross-section in FIG. 10. On one surface 73A of said container 73 is a slit or opening 84 through the above laminate.

Since the inner layer of pouch 73 is preferably coated with LLDPE, stress concentrator member 25 is also preferably coated with a layer of LLDPE to a thickness of approximately 0.001" to allow bonding between the two surfaces, along a peripheral edge portion 89 of stress concentrator member 25. Stress concentrator member 25 is preferably aligned within said pouch to position said fault line 24 under the slit opening 84.

Figure 10B:
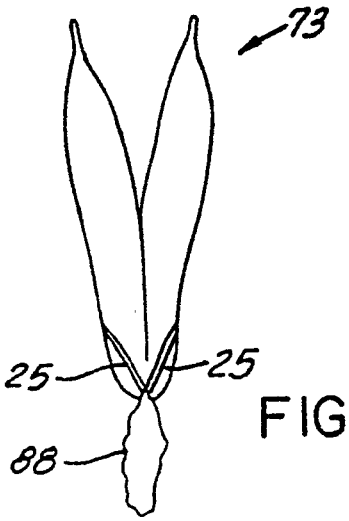
FIG. 10B is a view in perspective of the pouch shown in FIG. 10A, showing the contents of the pouch flowing out of the pouch.

Stress concentrator member 25 is preferably firmly attached to the inside surface 73B of the pouch 73 underneath and around the slit 84 thereby blocking any product within the pouch from contacting the slit opening 84. When the pouch is filled with a flowable substance, sealed and ready to use, as in the dispenser package embodiment shown in FIG. 10A, simple bending of the pouch into a "V" configuration, where the fault line preferably runs along the peak of the "V", ruptures the internal stress concentrating pattern 26 of stress concentrator member 25, allowing the flowable substance 88 to flow out of the pouch 73, as shown in FIG. 10B. Preferably, the fault line is in approximate alignment with the slit in the pouch wall, thereby providing a clear path for the product to be expelled from the package upon further squeezing. It will be readily understood by those skilled in the art that other configurations, orientations, and placements of stress concentrator member 25 and slit opening 84 on pouch 73, or other types of containers employing them, fall within the present invention.

Figure 11A:
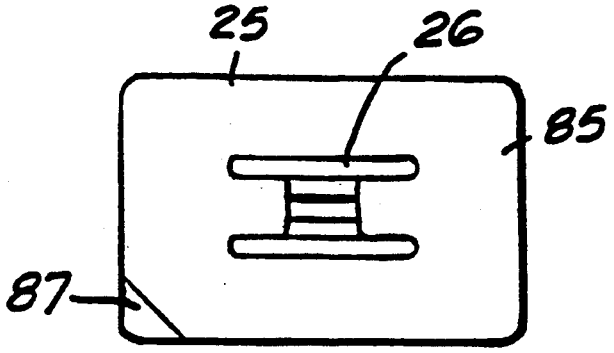
FIGS. 11A and 11B are views of a container such as for soft butter, employing a stress concentrator in accordance with the present invention.
Figure 11B:
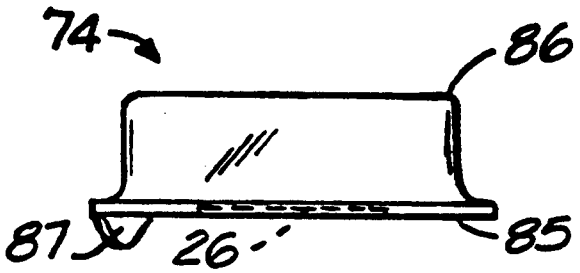

A further embodiment of the present invention employs a stress concentrator member 25 in domed dispenser packages for products such as butter. As shown in FIGS. 11A and 11B, stress concentrator member 25 is affixed to or forms the substantially flat surface 85 of container 74, which encloses a small amount of soft butter, margarine, or like substance within a semi-rigid plastic dome 86. Also shown in FIGS. 11A and 11B is a peel tab 87 which a user may pull to open the package in a conventional way. The stress concentrator member 25, however, offers the user another way to access the stored butter. By bending said stress concentrator member 25 across the fault line 24 or squeezing the plastic dome 86, the user may rupture the stress concentrating protrusion pattern 26 across the fault line 24, as previously discussed, and thereby access the stored substances.

Figure 12:
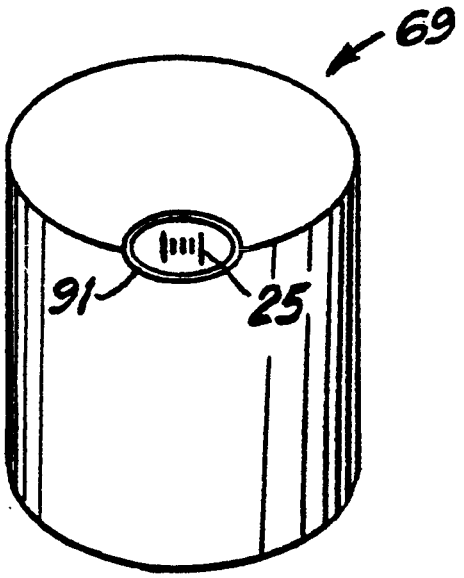
FIG. 12 illustrates a container such as for milk or orange juice, having a trimmed corner employing a stress concentrator member in accordance with the present invention.

A further embodiment of the present invention is a container 69 such as for milk, which is trimmed along one corner, forming a surface 91, as shown in FIG. 12. Container 69 is preferably made of blow-molded plastic. A stress concentrator member 25 may be placed on surface 91, and may be pressed to initially rupture the protrusion pattern 26 open. Squeezing container 69, as with the previous container embodiments, opens the protrusion pattern 26, and release of pressure causes the pattern 26 to retract. Preferably, stress concentrator member 25 is initially covered by a pull-tab seal, which is removed when the user desires to access the contents. As mentioned, the user preferably presses and ruptures the pattern 26 prior to use.

It will be understood by those skilled in the art that the present invention in its broader aspects is not limited to the particular embodiments shown and described herein, and that variations may be made which are within the scope of the accompanying claims without departing from the principles of the invention and without sacrificing its chief advantages.

What is claimed is:

1. Stress concentrator means for packages or containers for a flowable substance, comprising:

a substantially flat relatively stiff sheet member formed from a relatively thin, relatively flexible material;

a stress concentrator aperture-forming means provided in said sheet member comprising at least one elongated, thin-walled protrusion member projecting from one surface of said sheet member and having a generally planar channel-shaped configuration;

said sheet member including a substantially flat peripheral edge portion around said stress concentrator aperture-forming means; and a fault line of predetermined length traversing said generally planar channel-shaped stress concentrator protrusion member;

whereby bending the ends of said generally planar channel-shaped stress concentrator-protrusion member about said fault line in the direction of the protecting protrusion member displaces said stress concentrator protrusion member out of said planar configuration and thereby ruptures said fault line;

said at least one channel-shaped stress concentrator protrusion member forming a relatively flexible and expandable aperture opening upon rupture of said fault line.

2. Stress concentrator means as claimed in claim 1, further including:

a flexible sheet material sealingly affixed to said peripheral edge portion of said substantially flat relatively stiff sheet member, said flexible sheet material having at least one pouch formation for containing a flowable substance therein;

wherein said pouch containing member is sealingly affixed to the surface of said peripheral edge portion which is adjacent said projecting protrusion member so that the surface opposite said sealed surface of said substantially flat relatively stiff sheet member is substantially free of projections;

whereby upon bending said substantially flat relatively stiff sheet member into a "V" about an axis extending along said fault line so that the arms of said "V" encapture said pouch, said fault line initially ruptures at the loci of the base of said at least one channel-shaped stress concentrator protrusion member to create said relatively flexible and expandable aperture opening through which said flowable substance is dispensed in a directed flow.

3. Stress concentrator means as claimed in claim 1, wherein said sheet member includes a foil barrier material.

4. Stress concentrator means as claimed in claim 1, wherein said sheet member includes a plastic barrier material.

5. Stress concentrator means as claimed in claim 1, wherein said sheet member includes both foil and plastic barrier materials.

6. Stress concentrator means as claimed in claim 1, further comprising a plurality of said elongated generally channel shaped stress concentrator members spaced apart in generally parallel relationship along said traversing fault line to thereby create a plurality of relatively flexible and expandable apertures along said fault line upon said rupture of said stress concentrator members.

7. Stress concentrator means as claimed in claim 6, wherein said plurality of generally parallel stress concentrator members are spaced sufficiently close together such that said rupture of said stress concentrator members causes said fault line to tear between each of said plurality of apertures so as to create at least one relatively flexible and expandable aperture of increased width along said fault line.

8. Stress concentrator means as claimed in claim 1 including at least one non-rupturable guard member protecting from said one surface of said sheet member adjacent said rupturable member.

9. Stress concentrator means as claimed in claim 8, wherein said at least one non-rupturable guard member has an elongated generally channel shaped configuration and is longer than said rupturable stress concentrator member.

10. Stress concentrator means as claimed in claim 8, wherein said fault line traverses only said rupturable stress concentrator member.

11. Stress concentrator means as claimed in claim 8, wherein said fault line traverses all protrusion members.

12. Stress concentrator means as claimed in claim 8, comprising a plurality of said stress concentrator members and wherein said fault some but not all rupturing protrusion one of said stress concentrator members.

13. Stress concentrator means as claimed in claim 1, wherein said channel shaped configuration of said stress concentrator member is generally "V"-shaped in cross-section along said fault line.

14. Stress concentrator means as claimed in claim 1, wherein said channel shaped configuration of said stress concentrator member is generally "U" shaped in cross-section along said fault line.

15. Stress concentrator means as claimed in claim 13, comprising a plurality of said stress concentrator members along said fault line, said stress concentrator members joined along common longitudinally extending edges to thereby form a plurality of spaced peaked configurations pointed in alternately opposed directions along said fault line.

16. A stress concentrator expandable aperture-forming member as claimed in claim 2, wherein said flexible sheet material is formed into at least two separately enclosed side-by-side pouches sealingly affixed to said surface of said substantially flat relatively stiff sheet member which is adjacent said projecting protrusion member, and including at least two of said channel-shaped protrusion members, at least one of which is positioned over each of said pouches, each of said channel-shaped protrusion members displacing at least a portion of said fault line out of the plane of said substantially flat relatively stiff sheet in a direction towards its associated pouch.

17. A stress concentrator expandable aperture-forming member as claimed in claim 1, wherein said stress concentrator aperture-forming means comprises a plurality of said channel-shaped protrusion members, wherein said stress concentrator aperture-forming means is recessed from a plane formed by said one surface of the substantially flat relatively stiff sheet member.

18. A stress concentrator expandable aperture-forming member as claimed in claim 1, wherein said package is internally pressurized.

19. A stress concentrator expandable aperture-forming member as claimed in claim 1, wherein said stress concentrating expandable aperture-forming member includes a plurality of rupturing protrusion members, wherein said rupturing protrusion members are adjacent to one another, wherein upon application of pressure said rupturing protrusion members rupture and form a relatively flexible and expandable aperture opening and wherein upon further pressure said relatively flexible and expandable aperture opening expands.

20. A container for a flowable substance, comprising;

a substantially flat sheet member formed from a relatively thin, relatively flexible material and made integral with a surface of said container;

a stress concentrator aperture-forming means provided in said sheet member comprising at least one elongated thin-walled protrusion member projecting from one surface of said sheet member and having a generally channel-shaped configuration;

said sheet member including a substantially flat peripheral portion around said stress concentrator aperture-forming means; and a fault line of predetermined length traversing said channel-shaped stress concentrator protrusion member;

wherein upon application of pressure to said container said channel-shaped stress concentrator aperture-forming means ruptures along said fault line forming said aperture opening through which said flowable substance flows, wherein said channel-shaped stress concentrator means is covered by a guard cover, wherein said guard cover has an interior side in contact with said channel-shaped stress concentrator means.

21. A container for a flowable substance as claimed in claim 20, further comprising a strut member securely fastened to said interior side of said guard cover, wherein upon covering said channel-shaped stress concentrator means with said guard cover said strut member abuts said channel-shaped stress concentrator means, wherein said strut member provides a counterforce to rupturing forces caused by applying pressure to said container.

22. A container for a flowable substance as claimed in claim 20, wherein said guard cover is removable.

23. A container for a flowable substance as claimed in claim 22, wherein said removable guard cover is peel-off.

24. A stress concentrator expandable aperture-forming member for packages or containers for a flowable substance, comprising:

a substantially flat relatively stiff sheet member formed from a relatively thin, relatively flexible material;

a stress concentrator aperture-forming means provided in said sheet member comprising at least one elongated thin-walled protrusion member projecting from one surface of said sheet member and having a generally channel-shaped configuration;

said sheet member including a substantially flat peripheral edge portion around said stress concentrator aperture forming means; and a fault line of predetermined length traversing said channel-shaped stress concentrator protrusion member;

whereby upon rupture of said fault line, said channel-shaped stress concentrator aperture-forming means forms a relatively flexible and expandable aperture opening, wherein said container defines a slit opening;

wherein said stress concentrating aperture-forming member is positioned within said container, wherein said one surface of said substantially flat sheet member is positioned along the interior surface of said container beneath said slit opening;

wherein said stress concentrating aperture-forming member is secured to said interior surface of said container around said slit opening, wherein said slit opening is not in direct contact with said flowable substance in said container; and wherein upon rupture of said channel-shaped stress concentrator means across said fault line, said flowable substance within said container flows through said stress concentrator aperture-forming means and said slit opening when pressure is applied to said container.

25. A container for a flowable substance as claimed in claim 24, wherein said container is a flexible pouch.

* * * * *

UNITED STATES PATENT AND TRADEMARK OFFICE

CERTIFICATE OF CORRECTION

PATENT NO. : 5,395,031

DATED : March 7, 1995

INVENTOR(S) : SANFORD REDMOND

It is certified that errors appear in the above-identified patent and that said Letters Patent is hereby corrected as shown below:

In Column 17, Claim 1, line 26, delete "protecting" and insert therefor -- projecting --.

In Column 18, Claim 12, lines 28-29, delete "some but not all rupturing protrusion" and insert therefor -- line traverses at least --.

Signed and Sealed this

Thirteenth Day of June, 1995

*Attest:*

*Attesting Officer*

BRUCE LEHMAN

*Commissioner of Patents and Trademarks*